US005360383A

United States Patent [19]

Boren

[11] Patent Number: 5,360,383

[45] Date of Patent: Nov. 1, 1994

[54] APPARATUS AND METHOD FOR TESTING AND EXERCISING CEVICAL MUSCLES

[76] Inventor: John P. Boren, 9440 Old Katy Rd., Houston, Tex. 77055

[21] Appl. No.: 962,530

[22] Filed: Oct. 16, 1992

[51] Int. Cl.[5] ..... A63B 23/025

[52] U.S. Cl. ..... 482/10; 482/100; 482/137; 482/148; 482/908

[58] Field of Search ..... 482/94, 98, 99, 100, 482/135, 136, 137, 198, 908, 10; 297/346, 349

[56] References Cited

U.S. PATENT DOCUMENTS

| | | | |
|---|---|---|---|
| 3,858,873 | 1/1975 | Jones . | |
| 3,998,454 | 12/1976 | Jones . | |
| 4,257,592 | 3/1981 | Jones . | |
| 4,349,193 | 9/1982 | Lambert, Jr. et al. | 482/908 |
| 4,493,485 | 1/1985 | Jones . | |
| 4,500,089 | 2/1985 | Jones . | |
| 4,511,137 | 4/1985 | Jones . | |
| 4,600,196 | 7/1986 | Jones . | |
| 4,666,152 | 5/1987 | Jones . | |
| 4,699,425 | 10/1987 | Ohlson | 297/349 |
| 4,746,114 | 5/1988 | Grider | 482/100 |
| 4,768,779 | 9/1988 | Oehman, Jr. et al. . | |
| 4,834,365 | 5/1989 | Jones . | |
| 4,836,536 | 6/1989 | Jones . | |
| 4,858,919 | 8/1989 | Jones . | |
| 4,893,808 | 1/1990 | McIntyre et al. | 482/10 |
| 4,902,008 | 2/1990 | Jones . | |
| 4,902,009 | 2/1990 | Jones . | |
| 4,989,859 | 2/1991 | Jones . | |
| 5,002,269 | 3/1991 | Jones . | |
| 5,004,230 | 4/1991 | Jones . | |
| 5,005,830 | 4/1991 | Jones . | |
| 5,007,634 | 4/1991 | Jones . | |
| 5,092,590 | 3/1992 | Jones . | |
| 5,135,452 | 8/1992 | Jones . | |
| 5,149,313 | 9/1992 | Jones . | |

FOREIGN PATENT DOCUMENTS

| | | | |
|---|---|---|---|
| 2841672 | 4/1980 | Germany | 482/142 |

OTHER PUBLICATIONS

"Nautilus Instruction Manual" for 4-way neck machine, 1979, found in 482/10, pp. 34–35.

"The Super Neck Developer" by World Sporting Goods, Inc., 1979 found in 482/10, *Coach & Athlete* Jan./Feb. 1979, vol. XXXXI, No. 4.

*Primary Examiner*—Richard J. Apley
*Assistant Examiner*—Jeanne M. Mollo
*Attorney, Agent, or Firm*—Bush, Moseley & Riddle

[57] ABSTRACT

An exercise machine (10) and method for testing and exercising the cervical muscles of a patient or user. A movement arm (58) is mounted for pivotal movement about a horizontal axis defined by stub shafts (64, 66) and has a head pad (60) adapted to be contacted by the head of the patient. The exercise machine (10) has a chair (22) mounted for rotation to a desired angular position and mounted for vertical adjustment by actuation of a foot lever (38) to position the chair (22) relative to movement arm (58) and head pad (60). Chair (22) is also mounted for translatory horizontal movement parallel to the pivot axis of the movement arm (58) and for translatory horizontal movement perpendicular to the pivot axis of the movement arm (58) by movable bases (45, 46) thereby to precisely position the head of a user relative to head pad (60) while the user is seated in the chair (22) and pivoted among angular positions. A strain gauge (117) has one end anchored to the fixed frame (20, 118) and the other end is secured to a releasable locking means (130, 132) for the pulley wheel (78, 86) to block rotation of the pulley wheel (78) for static testing of the cervical muscles.

24 Claims, 6 Drawing Sheets

APPARATUS AND METHOD FOR TESTING AND EXERCISING CEVICAL MUSCLES

BACKGROUND OF THE INVENTION

1. Field of the Invention

This invention relates to an apparatus and method for testing and exercising cervical or neck muscles, and more particularly to such an apparatus and method in which a user is in a seated position and exerts a head motion against a head pad for the testing and exercising of the cervical muscles.

2. Description of Prior Art

The human spine, specifically the neck, is subject to numerous external forces that produce damage to the support structures that are responsible for the maintenance of the mechanical integrity. This area called the cervical or c-spine, while subject to invasive tumors, infection or metabolic disease is more often traumatized by external forces than internal pathology.

The wear and tear of daily living takes its toll on the muscles, tendons and ligaments which in turn may result in erratic motion between one vertebrae and the next. Impact trauma or repetitive stress likewise produces neck pain while instability allows pinching of adjacent nerves or never fibers. Even though a dysfunctional spine may not produce pain, when it becomes dysfunctional, the instability usually produces pain.

From the standpoint of stability, muscular tonicity has a dynamic role in the mechanical integrity necessary for dynamic motion of the cervical spine. When this strength or muscular tone is lost due to impact trauma or repetitive stress, individual joint stability is likewise lost. If the spine is only as strong as the muscles that give it support, a correlation exists between paraspinal muscular strength and normal function. Pain resulting from instability and dysfunction usually occurs at the nerve rootlets as they exit the spinal cord and are subject to compression, pinching and indirect facilitated pressure.

Inactivity of muscles or limitation of joint movement also results in muscular disuse atrophy. This atrophy represents loss of strength. While the immobilization of joints limits the pain associated with motion it also perpetuates the loss of strength. Treatment of neck pain includes a variety of remedies to reduce pain. A non-medical, non-invasive and safe exercise program is frequently recommended by physicians in order to compensate for the strength loss during inactivity and recovery.

Heretofore, such as shown in U.S. Pat. No. 5,002,269 dated Mar. 26, 1991, an apparatus has been provided for testing and exercising cervical or neck muscles in which a user is seated with the upper torso below the neck immobilized and the head positioned against a head pad on a movement arm pivotable about a generally horizontal axis. The movement arm is urged against movement in a rearward direction by a freely yieldable resistance weight. The user's cervical muscles produce a force to cause the head to move rearwardly to pivot the movement arm rearwardly against the resistance weight which is lifted as the movement arm is pivoted rearwardly. The subject's head is then moved forwardly causing the movement arm under the force of the resistance weight to pivot forwardly as the resistance weight descends. The exercise is repeated until the subject is no longer able to pivot the movement arm rearwardly. To test the static strength of the cervical muscles in the apparatus of U.S. Pat. No. 5,002,269, the movement arm is fixed in several different angular positions and in each position the subject exerts a force for pressing the head rearwardly against the movement arm, and the magnitude of the force is measured and recorded. Once the static strength of the subject's cervical muscles is determined, a safe resistance weight less than the static strength of the muscles, is chosen to be used in the dynamic test or exercise.

U.S. Pat. No. 4,989,859 dated Feb. 5, 1991 discloses a method of exercising rotary neck muscles of the human body including providing a head pad assembly mounted for rotary movement about a vertical axis and having a pair of opposed spaced pads engaging opposite sides of the head of the user while the torso is immobilized below the neck. The user turns or twists his head from one side to the other and a resistance weight is operatively connected to a frame for the head pad assembly to resist rotary motion of the head.

U.S. Pat. No. 4,768,779 dated Sep. 6, 1988 shows a neck exercise apparatus in which the head of a user is positioned within a helmet and a hydraulic actuator resists movement of the helmet. A strain gauge is provided to measure static testing of the neck upon pivotal locking of the helmet against movement.

SUMMARY

The cervical exercise machine of the present invention was designed to evaluate, assess and strengthen the cervical spine. The muscles involved in right and left lateral flexion as well as flexion extension of the head and neck during the exercising are: (1) rectus capitus lateralis, (2) scalenius anterior, (3) scalenius medius, (4) scalenius posterior, (5) splenius, (6) capitis, (7) cervicis, (8) erector spinaè, and (9) sternocleidomastoidious.

The cervical exercise machine is unique in that it performs cervical spine exercises on a user seated in a chair with the chair capable of being rotated to a selected one of four separate horizontal positions of the chair while the person being tested remains in the chair. Further, the chair with the seated patient may also be moved along a y-axis in a horizontal direction perpendicular to the head pad along a y-axis, and in a horizontal direction parallel to the head pad along an x-axis. In addition, the chair with the patient seated thereon may be raised and lowered relative to the head pad. Thus, the head of a patient may be precisely positioned relative to the head pad against which a resistance may be applied against movement of the head pad thereby to produce accurate test results.

In addition to this unique head placement capability, the measurements taken during static testing represent flexion extension and the right and left lateral bending range of motion upon movement of the head in contact with the head pad on a movement arm attached to a goniometer. This measurement is simultaneously transmitted electronically by a potentiometer, stored in a computer and made visible on a screen. Once the range is established in each of the four positions, the patient being tested exerts a maximum force at various intervals throughout the range of motion. The isometric force at each fixed position or angle is measured by an attached strain gauge which converts an analog signal to a digital signal for readout on a computer. This readout represents a strength curve of the patient when the peak torques of the several angles tested are connected by a spline line.

While other prior art cervical exercise machines have produced machines capable of various measurements of the cervical spine, the prior art machines do not provide a chair for the patient which is movable in a horizontal direction toward and away from a head pad along a y-axis and movable in a horizontal direction parallel to the head pad along a x-axis with the chair being elevated and lowered along a z-axis. In addition, such prior art cervical exercise machines do not include a chair rotatable about a vertical axis for testing a patient at four angular positions at 90° intervals. The positioning of the patient at a predetermined position allows a precise positioning of the head against the head rest which results in increased accuracy and comfort.

The present invention is particularly directed to an apparatus and method for testing and exercising the cervical or neck muscles of a user in which a head pad adapted to be contacted by the head of the user is mounted on a movement arm pivoted about a horizontal axis. A chair for the patient is mounted for translation along the x-y axes and for rotative movement about a vertical axis for selective positioning relative to the head rest at one of four rotative positions for exercising a selected portion of the neck muscles of the patient. For example, in one selected position of the chair with the chair facing forwardly, the back of the user's head rests against the head rest. In another position with the chair facing rearwardly, the forehead or front of the user's head rests against the head rest. In the other two positions of the chair, the right or left side of the user's head contacts the head rest.

A resistance weight is operatively connected to the movement arm and pivotal movement of the movement arm from a force exerted by the head of a user against the head rest lifts the resistance weight in the dynamic testing or exercising. In the static testing, the movement arm is normally blocked from the resistance weight and a strain gauge is provided to measure the static strength of the cervical muscles.

It is an object of this invention to provide an apparatus and method for testing and exercising the cervical muscles of a patient seated on a chair mounted for movement in selected directions for precisely positioning the desired side of the head of a patient against a head pad for exercising the cervical muscles.

It is an additional object of this invention to provide such a chair for a cervical exercise machine in which a patient seated in the chair may be moved with the chair in a perpendicular direction to the head pad along a y-axis and in a parallel direction to the head pad along an x-axis for precisely positioning the head of a patient against the head pad.

Another object of this invention is to provide such a chair for a cervical exercise machine which may be raised and lowered to a desired height and may be rotated about a vertical axis to a predetermined angular position relative to the head pad.

It is a further object of this invention to provide such an apparatus and method in which a chair on which the patient is seated may be easily rotated to a desired one of four predetermined angular positions of the seat for positioning a desired portion of the head against a head pad for exercising the cervical muscles.

Other objects, features, and advantages of the present invention will become more apparent after referring to the following specification and drawings.

DESCRIPTION OF THE INVENTION

Figure 1:
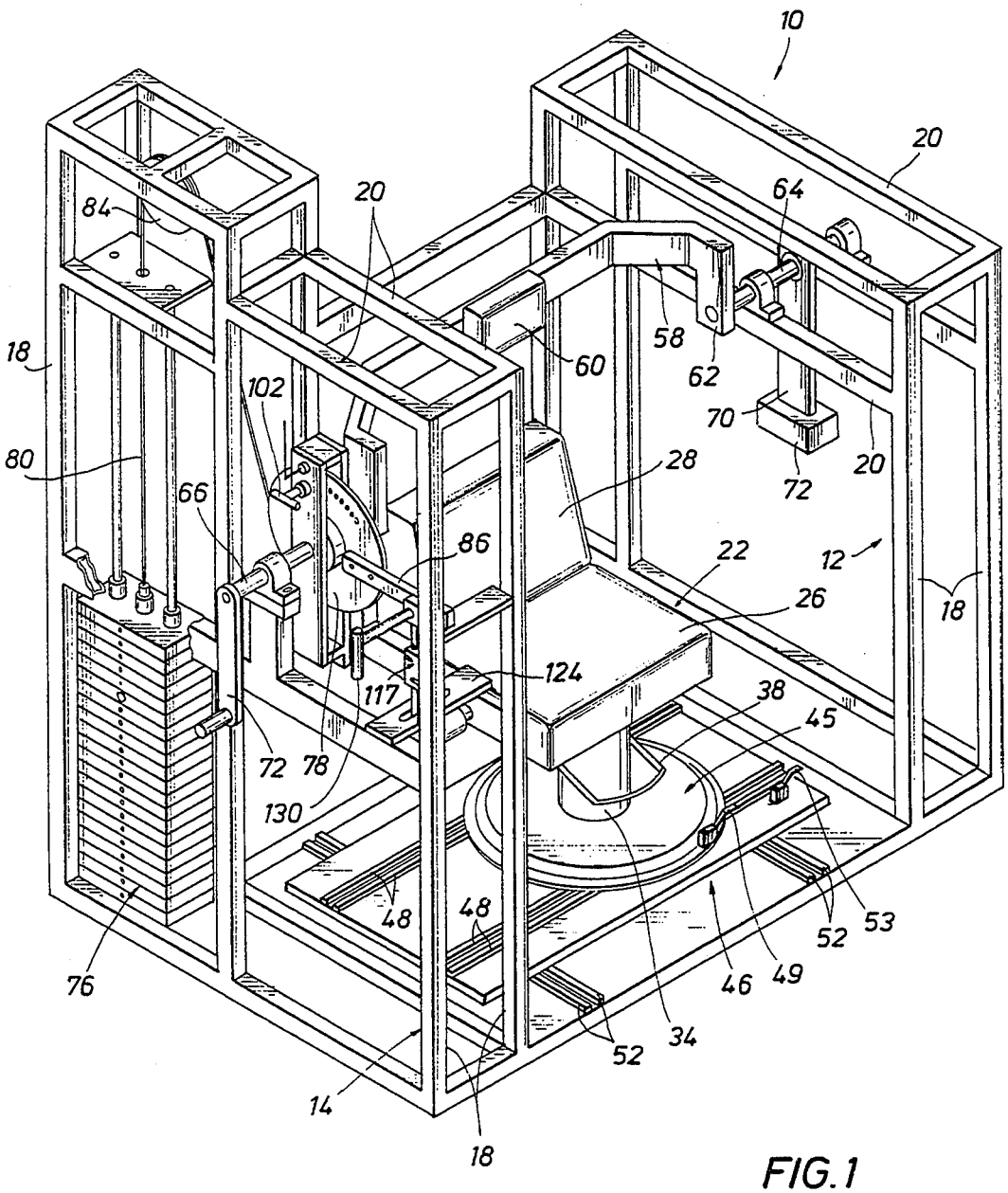
FIG. 1 is a perspective of the cervical exercise machine of the present invention.

Referring now to the drawings for a better understanding of this invention, and more particularly to FIGS. 1–4, an exercise apparatus or machine comprising the preferred embodiment of the present invention is shown generally at 10 and includes a pair of upstanding vertically extending side frames 12 and 14 connected by a horizontally extending base frame 16 supported on a floor. Side frames 12 and 14 include suitable vertical frame members 18, horizontal frame members 20, and other structural frame members secured together to form side compartments on which decorative panels may be mounted, if desired.

Figure 4:
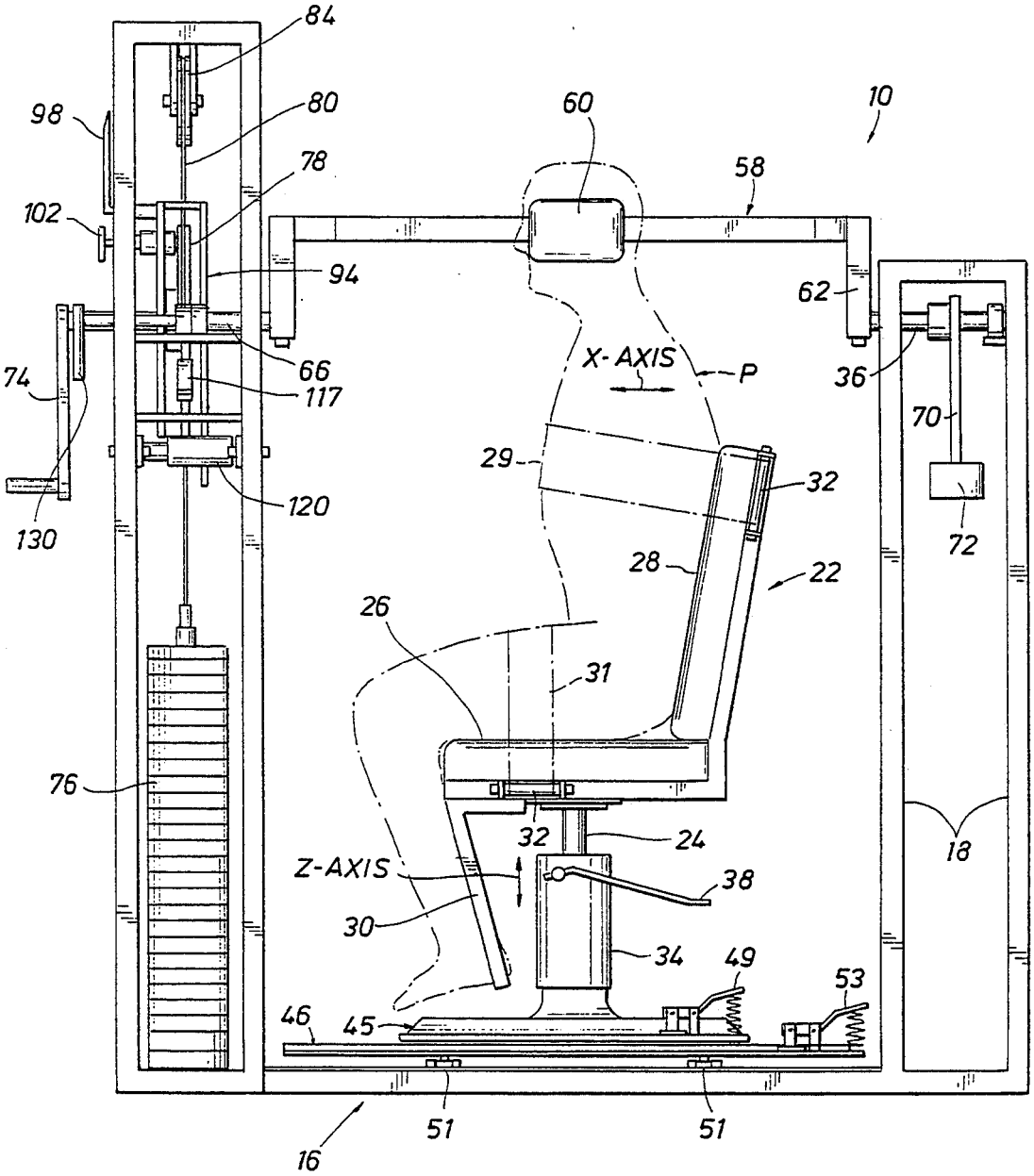
FIG. 4 is a front elevation similar to FIG. 2 but showing the seat lowered and rotated 90° while the chair is moved laterally of the head pad to position a side of the patient's head against the head pad for exercising and testing.

A chair or seat is generally indicated at 22 and has a shaft 24 extending therefrom. Chair 22 includes a lower seat pad 26, a back pad 28, and a foot rest 30. Upper and lower strap anchoring bars 32 on chair 22 may be manually gripped for stabilizing a patient or user during exercising or testing. An upper strap or belt 29 is releasably secured across the chest of a user and a lower strap or belt 31 is releasably secured across the thigh of a user. Vertical shaft 24 is received within a base 33 having a cylindrical extension or hub 34 and a suitable rack and pinion assembly (not shown) within cylindrical extension 34 is operatively connected to a horizontal shaft 36. A foot operated lever 38 connected to shaft 36 may be actuated for raising and lowering chair 22 along a z-axis and to permit rotation of chair 22 and shaft 24 about a vertical axis formed by shaft 24 to one of four angular positions arranged at 90° to each other, i.e., front, rear, left side and right side. FIG. 4 shows chair 22 rotated 90° from a forward position to a right side position.

To mount chair 22 for translation in one horizontal direction along an x-axis and for translation in another horizontal direction along a y-axis at right angles to the first horizontal direction, upper and lower movable bases generally indicated at 45 and 46 are provided with base 45 mounted for adjustable movement along the x-axis and base 46 mounted for adjustable movement along the y-axis. To mount base 45 for adjustable movement, a pair of shoes or strips 47 secured to the bottom of base 45 are mounted in tracks or guides 48 secured to base 46 for selective sliding movement. A foot pedal 49 may be depressed to withdraw plunger 50 from an aligned opening in lower base 46 to permit sliding movement of chair 22 to a desired location with foot pedal 49 released to permit plunger 50 to be received within a suitable aligned opening in lower base 46 for releasably securing chair 22 in the desired position along the x-axis.

To mount base 46 for adjustable movement, a pair of shoes or strips 51 secured to the bottom of base 46 are mounted in tracks or guides 52 secured to base frame 16. A foot pedal 53 may be depressed to withdraw plunger 54 from an aligned opening in base frame 16 to permit sliding movement of chair 22 to a desired location where foot pedal 53 is released to permit plunger 54 to be received within a suitable aligned opening in base frame 16 for releasably securing chair 22 in the desired position along the y-axis.

A generally U-shaped movement arm generally indicated at 58 is mounted above seat 22 and has an upper head pad or rest 60 secured thereto and adapted to contact the head of a patient or user with the user exerting a rearward force against head pad 60 for pivotal movement of movement arm 58. Movement arm 58 has opposed ends 62 which are secured to integral stub shafts 64 and 66 at opposite ends thereof extending in a horizontal direction to mount movement arm 58 for rotation about a horizontal axis. Suitable bearings 68 secured to side frames 12 and 14 mount stub shafts 64 and 66 for rotation. An arm 70 secured to stub shaft 64 has a counterweight 72 fixed to its extending end and aids in a return of movement arm 58 to its original rest position after pivoting of movement arm 58 from motion of the head.

Figure 5:
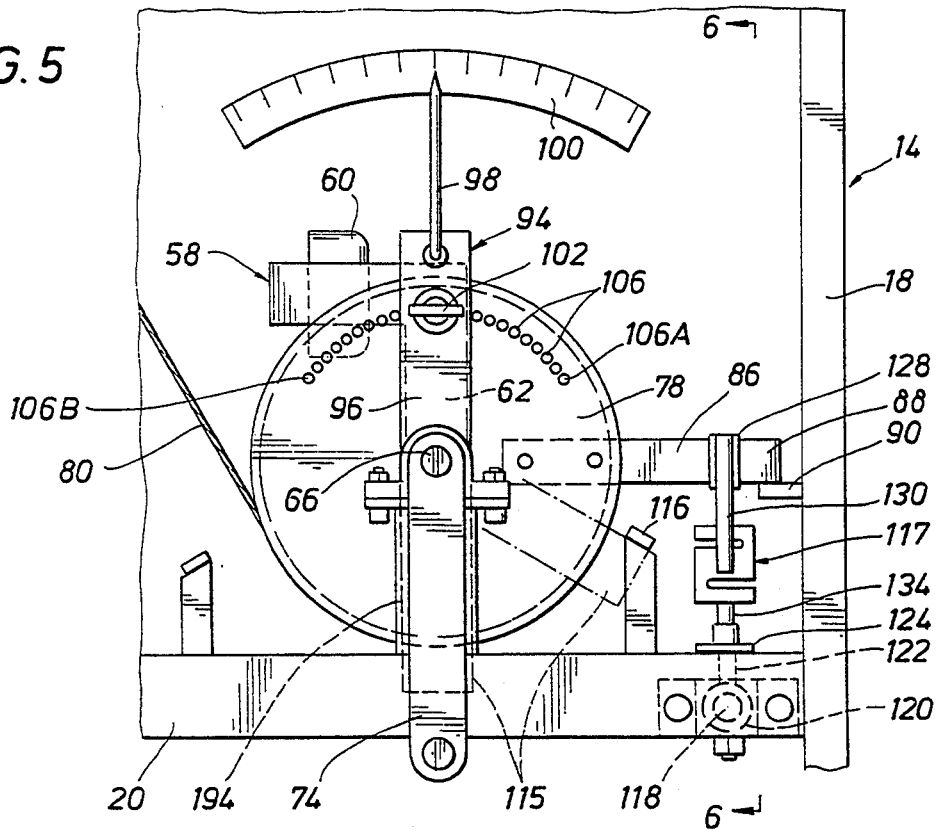
FIG. 5 is an enlarged side elevational view of releasable lock means for releasably connecting the movement arm to the pulley wheel and showing releasable locking means for releasably connecting the strain gauge to the pulley wheel.
Figure 6:
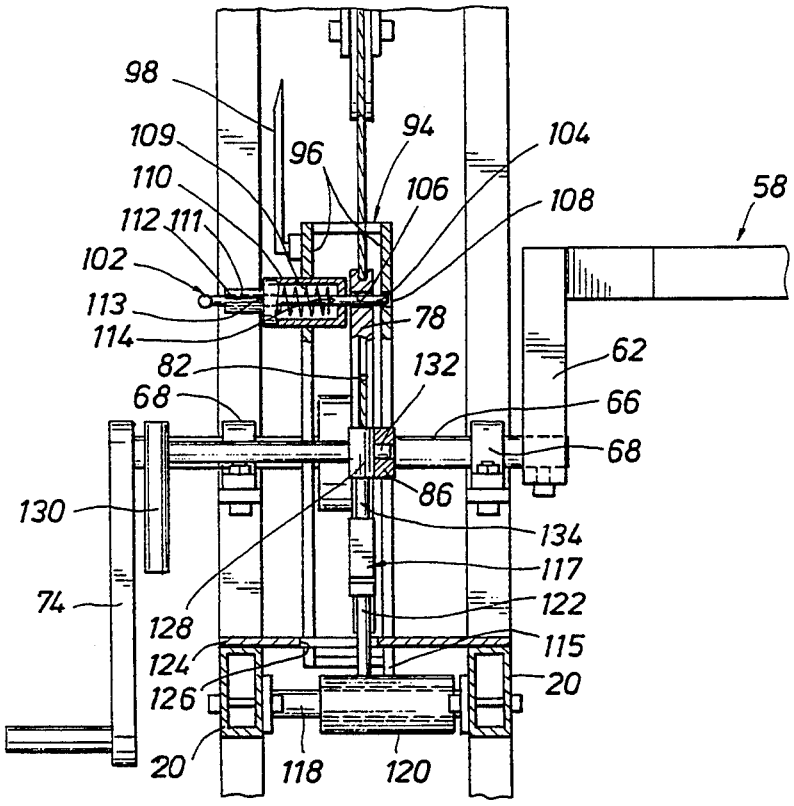
FIG. 6 is a front elevational view, partly in section, of the releasable lock means shown in FIG. 5 showing the locking means releasably connecting the movement arm to the pulley wheel and the strain gauge releasably connected to the pulley wheel as required for static testing of the user.

Referring now more particularly to FIGS. 5–8, the resistance weights for movement arm 58 and the drive connection between the resistance weights and movement arm 58 are illustrated for both the static test mode and the exercise mode which generally follows the static test mode. U-shaped movement arm 58 is secured to stub shaft 66 (see also FIG. 3) which is mounted for rotation within bearings 68. A manually operated crank arm 74 is secured to the end of stub shaft 66 and is utilized for manually adjusting the angular relationship of movement arm 58 relative to the resistance weights shown at 76 in FIGS. 1 and 2. Thus, crank arm 74 is secured to movement arm 58 and rotates with it. A pulley wheel 78 is mounted for relative rotation on stub shaft 66. A cable 80 has one end anchored to pulley wheel 78 at 82 as shown in FIG. 6 and extends about idler pulley 84 to weight stack 76. An end of cable 80 is connected to weight stack 76 and the amount of resistance from weight stack 76 may be manually adjusted as well known to provide resistance from a predetermined number of weights.

Pulley wheel 78 has an extending arm 86 secured thereto. An extending end portion 88 of arm 86 is adapted to contact a fixed stop 90 secured to side frame 14 to limit the rotative movement of pulley wheel 78 in a clockwise direction as viewed in FIGS. 3 and 5 when pulley wheel 78 is releasably locked to shaft 66. Arm 86 has an opening 92 therethrough adjacent end portion 88. (see FIG. 8).

Figure 7:
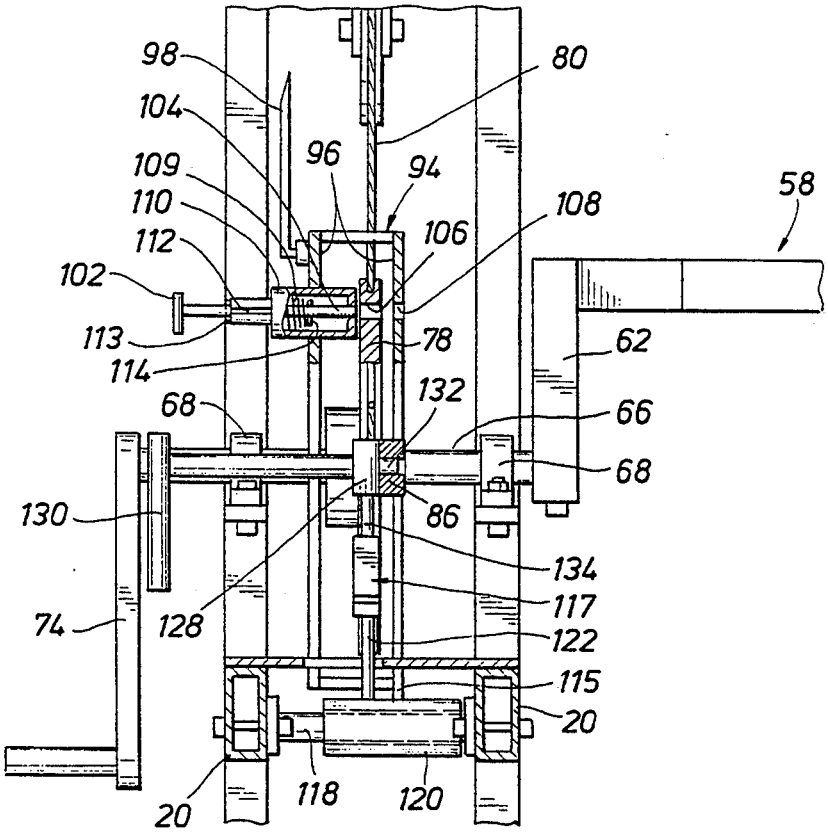
FIG. 7 is a front elevational view similar to FIG. 6 but showing the locking means for the movement arm disconnected from the pulley wheel to permit angular adjustment of the movement arm relative to the pulley wheel as necessary for static testing of the user at different angular positions.

Releasable locking means are provided to connect movement arm 58 in driving relation to pulley wheel 78 and weight stack 76. A box-like lever (see FIG. 6) having open sides is shown generally at 94 and is secured to stub shaft 66 for rotation therewith. Lever 94 includes front and rear plate members 96. Front plate member 96 has a pointer 98 secured thereto and cooperates with a fixed angular scale 100 to indicate the angular relation of movement arm 58 relative to a horizontal axis as shown in FIG. 5. Scale 100 is secured to side frame 14 and may for example be graduated from 0° to 70°. As shown in FIG. 5, pointer 98 is shown in a centered position at 35° with head pad 60 of movement arm 58 extending in a generally vertical plane. For releasably connecting pulley wheel 78 to shaft 66 for rotation therewith, a manually actuated rod generally indicated at 102 forms a releasable locking means and has an inner end 104 which may be received within a selected one of a plurality of openings 106 in pulley wheel 78. A rearmost opening is shown at 106B and a forward most opening is shown at 106A. Front and rear plate members 96 of lever 94 have aligned openings 108 therein to receive inner end 104 as shown in FIG. 7. To maintain end 104 within opening 108, a spring 109 is received within a housing 110 fixed to outer plate 96. A sleeve 111 having a slot 112 therein receives a pin 113 secured to rod 102. Sleeve 111 is secured to housing 110 and a pin 114 secured to pin 113 engages an end of spring 109. Rod 102 is pulled outwardly to retract end 104 from aligned openings 106, 108 and pin 113 moves to the end of slot 113. Then, rod 120 is rotated to position pin 113 against the end of sleeve 111 against the bias of spring 109 which is compressed by pin 114. Spring 109 continuously urges rod 102 into a projected position by contact with pin 114.

To limit movement of lever 94 in a counterclockwise direction past 0° on scale 100, lever 94 has a lower projection or stop 115 as shown particularly in FIG. 5 adapted to engage a cross bar 116 extending between horizontal frame members 20. As shown in the drawings, movement arm 58 upon adjustment of lever 94 may swing in an angular relation as much as 70° if pin 102 is secured within opening 106A and as little as 0° if pin 102 is received within opening 106B as shown in FIG. 5. Arm 86 engages stop 90 at the beginning and end of each cycle under the bias of weight stack 76 exerted by cable 80. For example, with lever 94 in the position of FIGS. 5 and 8 releasably locked to pulley wheel 78, head force of a user exerted against head pad 60 moves movement arm 58 in a counterclockwise position of 35° until stop 115 engages cross bar 116 as shown in broken lines in FIG. 5. Arm 86 and pulley wheel 78 likewise are rotated in a counterclockwise direction as indicated by broken lines in FIG. 5. Upon release of the head force of the user against head pad 60, weight stack 76 through cable 80 urges pulley wheel 78 in a clockwise direction to return arm 86 to stop 90 for the completion of a cycle.

A cycle comprises a positive movement of head pad 60 and movement arm 58 in a counterclockwise direction such as 35° and a negative return movement of head pad 60 and movement arm 58 in a clockwise direction of 35°. If rod 102 is received within opening 106A (FIG. 5), a cycle of 70° would be obtained in a similar manner. The movement of movement arm 58 as set forth above is the type of movement for the exercise mode of exercise machine in which the weight stack 76 through cable 80 continuously urges pulley wheel 78 in a clockwise position to maintain arm 86 against stop 90 unless a rearward force is exerted against head pad 60 in a counterclockwise direction as viewed in FIGS. 1 and 5. Hand grips 32 are provided so that a patient may stabilize the torso below the neck during testing and exercising.

A static strength test to test the static strength of the cervical muscles at each of the different angular positions of the head against head pad 60 is determined by the set angular position of movement arm 58 and lever 94 relative to pulley wheel 78 as provided by a selected opening 106. In order to measure the static strength of the cervical muscles, a strain gauge generally indicated at 117 is provided. Strain gauge 117 is releasably locked to arm 86 in an operable position for the static test mode and is disconnected from arm 86 in an inoperable position for the exercise mode.

Figure 8:
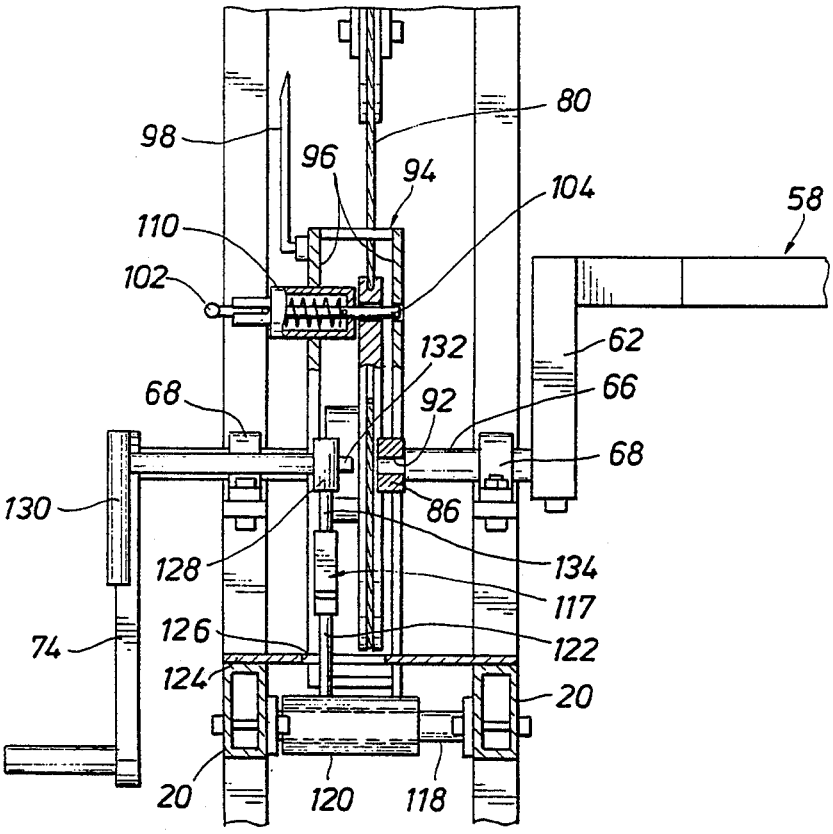
FIG. 8 is a front elevational view similar to FIGS. 6 and 7 but showing the locking means for the movement arm releasably locked to the pulley wheel and showing the strain gauge disconnected from the pulley wheel as in the dynamic exercise mode of the exercise machine.

For mounting strain gauge 117, a support shaft 118 is secured between horizontal frame members 20 of fixed side frame 14. A sleeve or collar 120 is slidably mounted on support shaft 118 and a lower connecting pin 122 is secured between sleeve 120 and strain gauge 117. A plate member 124 is secured between frame members 20. An elongated slot 126 therein receives pin 122 as shown in FIGS. 6–8 for guiding strain gauge 117. An upper block 128 has a manually actuated handle 130 secured thereto on one side and has a projecting pin or prong 132 on an opposite side. An upper rod 134 is secured between strain gauge 117 and block 128. Inner prong or end 132 of handle 130 is adapted to fit selectively within opening 92 of arm 86.

FIG. 8 shows strain gauge 117 in a an inoperable position for the exercise mode disconnected from arm 86 with prong 132 removed from opening 92. FIGS. 6 and 7 show strain gauge 117 in an operable position connected to arm 86 for measuring the static strength of the cervical muscles with prong 132 received within opening 92 of arm 86 and moving with pulley wheel 78 and movement arm 58. Handle 130 is manually gripped and pushed inwardly with collar 120 sliding along support shaft 118 to insert prong 132 within opening 92. During the exercise mode of exercise machine 10, strain gauge 117 is disconnected and does not move with movement arm 58.

Figure 2:
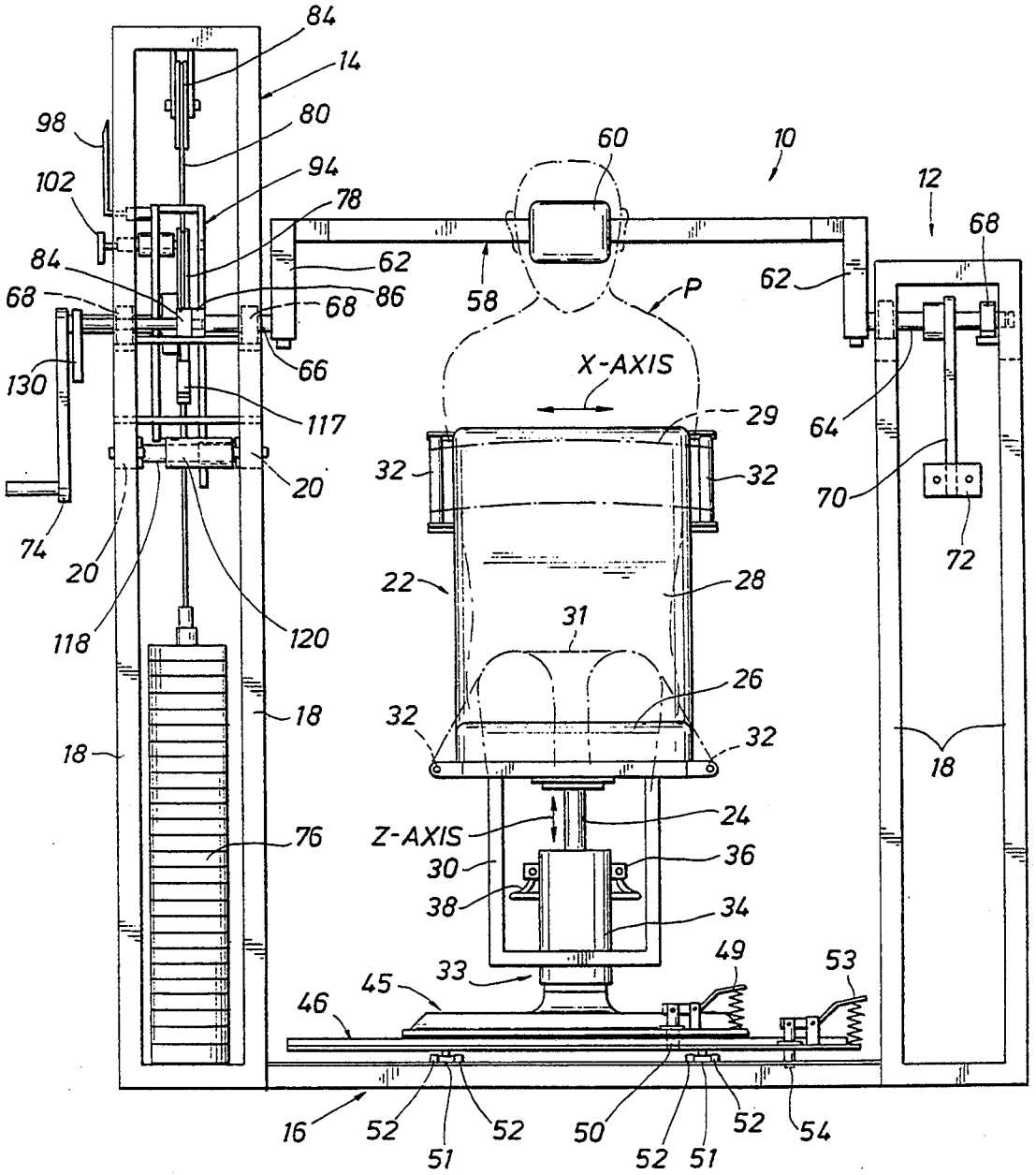
FIG. 2 is a front elevation of the machine shown in FIG. 1 with the back of the head of a patient in contact with the head pad.
Figure 3:
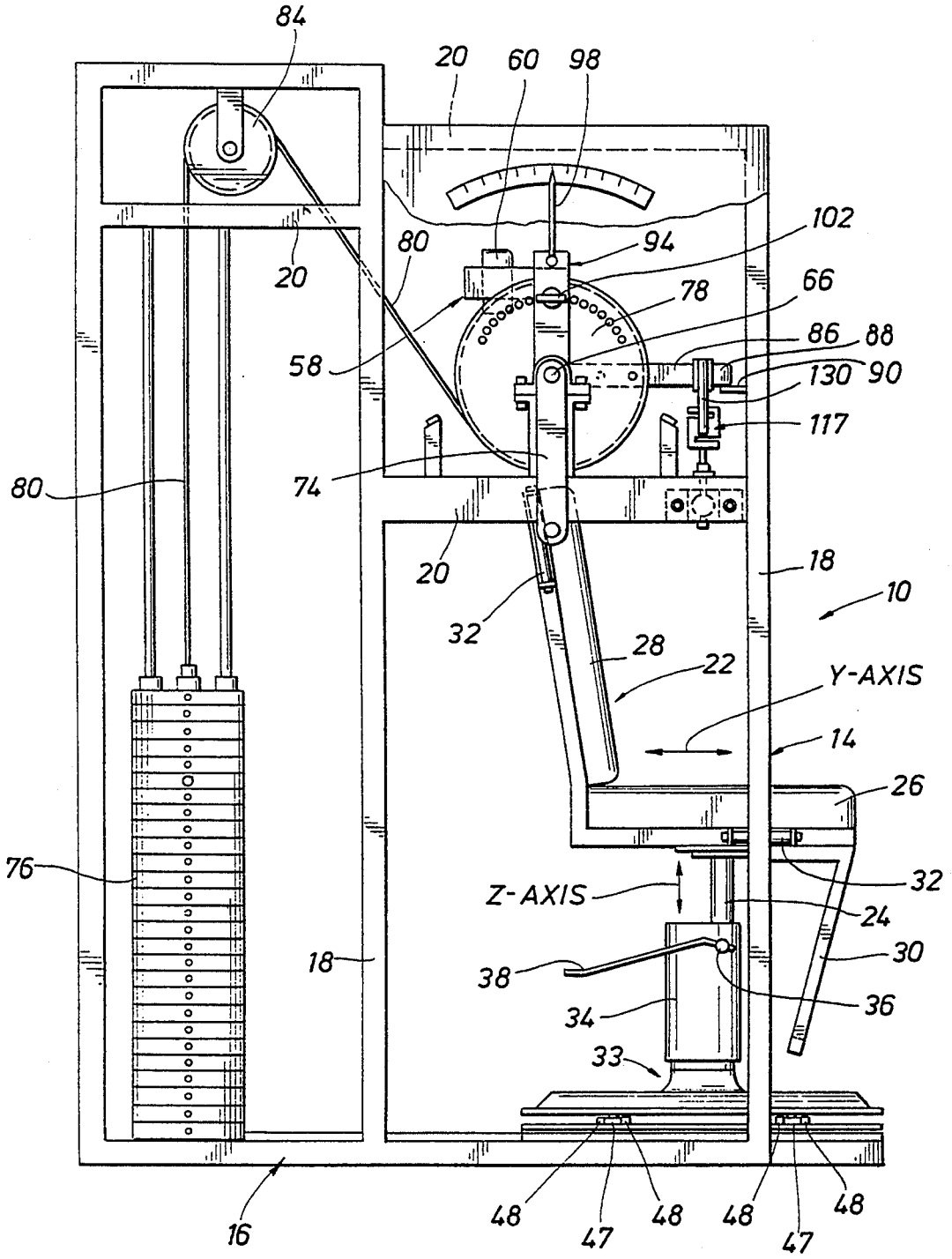
FIG. 3 is a side elevation of the machine shown in FIGS. 1 and 2.

Prior to the establishing of an exercise or rehabilitation program, the static strength of the cervical muscles is first determined over a range of different angular positions of the head between an upright position of the head and bent position of the head against head pad 60. The patient and chair 22 are positioned at a selected one of four horizontal positions at 90° intervals to each other. FIGS. 1–3 show the patient and chair 22 in a forward direction with the back of the head engaging head pad 60 while FIG. 4 shows the patient in a right side position with the right side of the head engaging head pad 60. For static testing with the patient in the position shown in FIGS. 1–3, strain gauge 117 is in engaged position with arm 86 of pulley wheel 78 and releasable lock means 102 is positioned within a selected opening 106 of pulley wheel 78 as shown in FIG. 6. Measurements from strain gauge 117 are taken from a predetermined number of selected openings 106 in wheel 78 by movement of locking means 102 as shown in FIG. 7 to various openings 106. A graph of the static strength is produced and recorded through a computer and displayed on a pair of computer monitors (not shown), one computer monitor for viewing by the user or patient and the other monitor adjacent a computer for viewing by an operator or technician for exercise machine 10. A keyboard, printer, and mouse (not shown) are also provided adjacent the computer for operation by an operator or technician of exercise machine 10 and an exercise program may be displayed on the monitor.

After the static strength of the cervical muscles is determined, strain gauge 117 is disconnected from arm 86 by outward movement of handle 130 to the position shown in FIG. 8. In this position, pulley wheel 78 is connected by cable 80 to a selected resistance weight from weight stack 76 and an exercise program is established for exercising the cervical muscles by pivoting of movement arm 58 in a rearward counterclockwise direction and return movement of arm 58 in a forward clockwise direction. In the rearward counterclockwise direction, force is exerted by the back of the patient's head against head rest 60 as shown in FIG. 2 for performing positive work in lifting the weight stack until the pivoting of movement arm 58 is stopped by stop 115 engaging bar 116 as shown in FIG. 5 with pointer 98 at 0° on scale 100. Then, the lifted weight stack urges pulley wheel 76 in a clockwise return position resisted by the back of the head until arm 86 engages stop 90 at the set position of lever 94 such as 35° as shown in FIG. 5. In some instances, it may not be desired for movement arm 58 to be stopped by stop 115.

Operation

In operation and referring to FIG. 2, a patient P is seated in a forward position on seat 22 with the back of the head against head pad 60 and seat 22 adjusted to a desired height for the patient by actuation of lever 38. Upper and lower straps 29, 31 are releasably secured across patient P. Bases 45 and 46 are positioned to the desired location by actuation of foot levers 49 and 53. Static testing of the cervical muscles is now performed as set forth above with strain gauge 117 engaged with pulley wheel 78 as shown in FIG. 6 and rod 102 engaging a selected opening 106 in pulley wheel 78. Strain gauge 117 measures the torque exerted by the patient when pressing rearwardly against head pad 60 of movement arm 58. Torque readings are taken from a predetermined number of angular positions of movement arm 58 as determined by lever 94 being releasably secured by rod 102 at a predetermined angular relation to pulley wheel 78. It may be desirable to provide static testing with the patient at a second position such as illustrated in FIG. 4. In this event, the patient is moved to the position of FIG. 4 while seated on chair 22. First, chair 22 is rotated 90° by actuation of lever 38 and lowered slightly by actuation of lever 38. Then, to position the side of the head precisely against head pad 60, foot pedal 53 is depressed and base 46 along with base 45 and chair 22 are moved rearwardly along track 52 to the desired location with pedal 53 then being released. Next, base 45 is moved to the left viewing FIG. 4 by depressing foot pedal 49 and manual sliding of base 45 and chair 22 to a precise positioning of the side of the head against head pad 60. Static testing of the cervical muscles is then repeated in a similar manner. It may be desirable for certain patients to provide static testing in the other two angular positions of chair 22. Thus, it is necessary that chair 22 be mounted for translatory movement along the x and y axes upon positioning of the head of the patient at a different angular relation to the head pad upon rotation of chair 22 since rotation of chair 22 changes the distance of the head from the head pad.

After completion of the static testing, strain gauge 117 is disconnected from arm 86 as shown in FIG. 8 and an exercise program for dynamic exercising is commenced with a predetermined weight resistance and a predetermined arc of travel of movement arm 58 between stops 90 and 116 which may vary from around 15° to 70°, for example. Chair 22 may be rotated to different angular positions for dynamic exercising as may be desirable for certain patients. Under certain conditions, it may be desirable to test a patient with various resistance weights to determine the work capacity of a patient before an exercise or rehabilitation program is established for a patient. Thus, a safe and effective exercise or rehabilitation program may be provided for each patient.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. An exercise machine for exercising cervical muscles of a seated user comprising:

a fixed frame adapted to be supported on a horizontal support surface;

a chair on said frame supporting a user in seated position for testing and exercising of the cervical muscles;

a movement arm mounted for pivotal movement about a horizontal axis and having a head pad thereon for contact with the head of the user for pivoting of the movement arm in a rearward direction by the head of the user exerting force against said pad;

means for raising and lowering said chair relative to said movement arm for adjusting the height of said chair;

means to pivot said chair in a horizontal plane about a vertical axis to a selected one of four positions at 90° intervals; and adjustable means to move said chair and said means to pivot said chair in a translatory motion selectively in two different directions at right angles to each other relative to said movement arm and head pad to a predetermined position;

said adjustable means, said means for raising and lowering said chair, and said means to pivot said chair permitting the front, back, right side, and left side of the head of the user to contact selectively said head pad for exercise of the neck of the user in four different directions.

2. An exercise machine as set forth in claim 1 wherein separate means mount said chair for sliding movement at right angles to the pivotal axis of said movement arm in a direction toward and away from said head pad.

3. An exercise machine as set forth in claim 1 wherein additional means mount said chair for sliding movement in a direction parallel to the pivotal axis of said movement arm and said head pad.

4. An exercise machine as set forth in claim 1 wherein an upper base supports said chair; and means mount said upper base for sliding movement at right angles to the pivotal axis said movement arm in a direction toward and away from said head pad.

5. An exercise machine as set forth in claim 4 wherein a lower base supports said upper base; and said means mounting said upper base for sliding movement comprises cooperating members on said upper and lower bases to guide and releasably position said upper base and chair on said lower base.

6. An exercise machine as set forth in claim 5 wherein a fixed base frame supports said lower base; and means mounting said lower base for sliding movement on said fixed base frame.

7. An exercise machine as set forth in claim 6 wherein said means mounting said lower base for sliding movement on said fixed base frame comprises cooperating members on said lower base and said fixed base frame to guide and releasably position said lower base on said fixed base frame, said upper base and said chair movable with said lower base.

8. An exercise machine as set forth in claim 1 wherein said means for raising and lowering said chair including means mounting said chair for vertical adjustment to a predetermined height relative to said head pad.

9. An exercise machine as set forth in claim 8 wherein said means mounting said chair for vertical adjustment includes a lower base support beneath said chair including a hub;

a vertical shaft is secured to said chair and received within said hub; and means on said hub raise and lower said shaft for adjusting the height of said chair relative to said head pad.

10. An exercise machine as set forth in claim 1 wherein said movement arm includes a stub shaft on each end thereof extending in a horizontal direction; and means on said fixed support frame support said stub shafts for pivotal movement of said movement arm.

11. An exercise machine as set forth in claim 1 wherein said means operatively connected to said movement arm to provide a predetermined resistance includes a weight stack; and means selectively connect said weight stack to said movement arm to resist pivotal movement of said movement arm in a rearward direction from a rest position from force exerted against said head pad by the head of a user.

12. An exercise machine as set forth in claim 11 wherein said weight stack and said means selectively connecting said weight stack to said movement arm continuously urges said movement arm in a forward pivotal movement to said rest position after pivoting in a rearward direction from said rest position.

13. An exercise machine as set forth in claim 12 wherein said means selectively connecting said weight stack to said movement arm comprises:

a pulley wheel mounted for relative rotation about said horizontal axis of said movement arm;

a cable extending from said pulley wheel to said weight stack; and a lever secured to the horizontal axis of said movement arm and releasably connected to said pulley wheel at a predetermined angular relation of said movement arm with said pulley wheel for transferring rotative movement of said movement arm to said pulley wheel.

14. An exercise machine as set forth in claim 13 further comprising:

means for blocking rotative movement of said pulley wheel and said movement arm when said lever is releasably connected to said pulley wheel;

a strain gauge for measuring the torque exerted by said movement arm in a rearward direction from said rest position; and means for selectively connecting said strain gauge to said pulley wheel for measuring the torque exerted by a user against said movement arm in a rearward direction.

15. An exercise machine for exercising cervical muscles of a seated user comprising:

a fixed frame adapted to be supported on a horizontal support surface;

a chair supporting a user in seated position for testing and exercising of the cervical muscles;

a movement arm mounted for pivotal movement about a horizontal axis and having a head pad for contact with the head of the user for pivoting of the movement arm in a rearward direction by the head of the user exerting force against said pad;

means for raising and lowering said chair relative to said movement arm for adjusting the height of said chair;

means mounting said chair for translatory horizontal movement selectively along two different axes at right angles to each other to permit said chair to be positioned at a predetermined position relative to said head pad;

means to pivot said chair in a horizontal plane about a vertical axis to a selected one of four positions at 90° intervals, said means to pivot said chair permitting the front, back, right side, and left side of the head of the user to contact selectively said head pad for exercise of the neck of the user in four different directions;

a horizontally extending shaft defining said horizontal axis and secured to the movement arm for rotation therewith upon pivotal movement of the movement arm;

a wheel mounted on said horizontal shaft for rotation relative to said shaft;

means connecting said wheel to a resistance to provide a predetermined resistance against rotative movement of said wheel in a rearward direction;

releasable lock means for releasably connecting said movement arm to said wheel for rotation of said wheel with said movement arm, said releasable lock means having a plurality of predetermined spaced positions for changing the angular position of the movement arm relative to the wheel to allow the movement arm to be positioned selectively at different angular positions relative to the wheel;

releasable means for blocking rotation of said wheel when said wheel is releasability connected to said movement arm; and a strain gauge operatively connected to said wheel for measuring the strength of the cervical muscles at a selected angular position of the movement arm upon force exerted by the head of the user against the head pad when rotation of said wheel is blocked and said wheel is connected to said movement arm.

16. An exercise machine as set forth in claim 15 wherein said strain gauge has one end thereof secured to said fixed frame.

17. A method for testing and exercising the cervical muscles of a user when in a seated position on an exercise machine; said method comprising the following steps:

providing a fixed frame for the exercise machine;

providing a chair facing in a forward position on which a user is seated for testing and exercise programs;

providing a movement arm mounted for pivotal movement about a horizontal axis and having a head pad adapted to be contacted by the head of the seated user;

providing means for pivoting said chair;

mounting said chair on a base for pivotal movement relative to said base;

mounting said base and said chair for translatory movement in a predetermined direction;

pivoting said chair about a vertical axis relative to said head pad from said forward position opposed side positions at right angles to said forward position for selectively positioning of the right and left sides of the head of the user against said head pad for pivoting said movement arm and for exercising the neck of the user in different directions;

movement said chair and said means for pivoting said chair in a translatory horizontal motion toward said head pad in a perpendicular direction to the pivot axis of said movement arm after said chair is pivoted to said side positions for precise positioning of the head of the user against said head pad;

resisting the pivoting of said movement arm from a rest position by force exerted by the head of the user against said head pad; and releasably connecting said movement arm and said resistance means together for testing and exercising the cervical muscles.

18. The method as set forth in claim 17 further comprising the step of:

moving said chair in a translatory horizontal motion parallel to the pivot axis of said movement arm for precise positioning of said head against said head pad.

19. An exercise machine for exercising cervical muscles of a seated user comprising:

a fixed frame adapted to be supported on a horizontal support surface;

a chair supporting a user in seated position for testing and exercising of the cervical muscles;

a movement arm mounted for pivotal movement about a horizontal axis and having a head pad thereon for contact with the head of the user for pivoting of the movement arm in a rearward direction by the head of the user exerting force against said pad;

means for raising and lowering said chair relative to said movement arm for adjusting the height of said chair;

means to pivot said chair in a horizontal plane about a vertical axis to a selected one of four positions at 90° intervals;

a horizontally extending shaft defining said horizontal axis and secured to the movement arm for rotation therewith upon pivotal movement of the movement arm;

a wheel mounted on said horizontal shaft for rotation relative to said shaft;

means connecting said wheel to a resistance to provide a predetermined resistance against rotative movement of said wheel in a rearward direction;

releasable lock means for releasably connecting said movement arm to said wheel for rotation of said wheel with said movement arm, said releasable lock means having a plurality of predetermined spaced positions for changing the angular position of the movement arm relative to the wheel to allow the movement arm to be positioned selectively at different angular positions relative to the wheel;

releasable means for blocking rotation of said wheel when said wheel is releasably connected to said movement arm; and a strain gauge operatively connected to said wheel for measuring the strength of the cervical muscles at a selected angular position of the movement arm upon force exerted by the head for the user against the head pad when rotation of said wheel is blocked and said wheel is connected to said movement arm;

said strain gauge having one end thereof secured to said fixed frame and the other end thereof releasably connected to said wheel for blocking rotation of said wheel and defining said releasable means for blocking rotation of said wheel.

20. An exercise machine as set forth in claim 19 wherein an arm is secured to said wheel and said other end of said strain gauge is connected to said arm during static testing of said cervical muscles for blocking rotation of said wheel.

21. An exercise machine as set forth in claim 19 wherein a weight stack is operatively connected to said wheel and provides resistance to rotation of said wheel in one direction away from a rest position of said movement arm; and a stop is provided at said rest position to limit the rotation of said wheel in an opposite direction under a rotative force exerted by said weight stack after said wheel is rotated in a rearward direction away from said rest position upon rearward pivotal movement of said movement arm by said user.

22. An exercise machine as set forth in claim 21 wherein said releasable lock means for releasably connecting said movement arm to said wheel comprises a lever secured to said horizontally extending shaft of said movement arm and releasably connected to said wheel at a predetermined angular relation of said movement arm with said wheel for transferring rotative movement of said movement arm to said wheel.

23. An exercise machine as set forth in claim 22 wherein a stop is provided to limit the rotation of said wheel in a rearward direction upon rearward movement of said movement arm when said wheel is releasably locked to said movement arm.

24. A method for testing and exercising the cervical muscles of a user when in a seated position on an exercise machine; said method comprising the following steps:

providing a fixed frame for the exercise machine;

providing a chair facing in a forward position on which a user is seated for testing and exercise programs;

providing a movement arm mounted for pivotal movement about a horizontal axis and having a head pad adapted to be contacted by the head of the seated user;

providing a wheel selectively connected to a resistance means;

providing a strain gauge for measuring the static strength of the cervical muscles;

connecting the strain gauge between the fixed frame and said wheel for blocking rotation of said wheel and for tensioning of said strain gauge for static testing of the cervical muscles;

mounting said chair on a base for pivotal movement relative to said base;

mounting said base and said chair for translatory movement in a predetermined direction;

pivoting said chair about a vertical axis relative to said head pad from said forward position to opposed side positions at right angles to said forward position for selectively positioning of the right and left sides of the head of the user against said head pad for pivoting said movement arm and for exercising the neck of the user in different directions;

resisting the pivoting of said movement arm from a rest position by force exerted by the head of the user against said head pad; and releasably connecting said movement arm and said resistance means together for testing and exercising the cervical muscles.

* * * * *